US005715631A

United States Patent [19]

Kailian et al.

[11] Patent Number: 5,715,631

[45] Date of Patent: Feb. 10, 1998

[54] WINDOW LATCH WITH MULTIPLE LATCHING FEATURE

[75] Inventors: Nourhan Kailian, York County, Dover Township; Darwin B. Dosch, York County, Windsor Township, both of Pa.

[73] Assignee: Appleby Systems, Inc., York, Pa.

[21] Appl. No.: 671,152

[22] Filed: Jun. 28, 1996

[51] Int. Cl.[6] ..... E05F 1/00

[52] U.S. Cl. ..... 49/450; 292/172

[58] Field of Search ..... 49/449, 450; 292/172, 292/175, DIG. 47

[56] References Cited

U.S. PATENT DOCUMENTS

| | | | |
|---|---|---|---|
| 242,695 | 6/1881 | Rich . | |
| 336,302 | 2/1886 | Dudgeon | 49/450 X |
| 547,883 | 10/1895 | Hall . | |
| 671,957 | 4/1901 | Hannum . | |
| 1,630,153 | 5/1927 | Williams . | |
| 1,857,294 | 5/1932 | Larson | 49/450 X |
| 1,857,295 | 5/1932 | Ehret | 49/450 X |
| 4,095,829 | 6/1978 | van Klompenburg | 292/241 |
| 4,525,952 | 7/1985 | Cunningham et al. | 49/449 |
| 4,553,353 | 11/1985 | Simpson | 49/449 X |
| 5,090,750 | 2/1992 | Lindqvist | 292/7 |
| 5,161,839 | 11/1992 | Piltingsrud et al. | 292/241 |
| 5,244,238 | 9/1993 | Lindqvist | 292/7 |
| 5,398,447 | 3/1995 | Morse | 49/185 |

*Primary Examiner*—Jerry Redman

*Attorney, Agent, or Firm*—Webb Ziesenheim Bruening Logsdon Orkin & Hanson, P.C.

[57] ABSTRACT

Disclosed is a multiple position window latch which includes a latch housing attached to a top rail of a window sash. A stem extends through the latch housing and a latch handle is positioned above the latch housing and is attached to an upper end of the stem. A sweep cam is positioned within the latch housing and is attached to the stem. The sweep cam rotates into and out of the latch housing and engages a keeper on an adjacent window sash. An elongated slide is positioned beneath the latch housing and extends within the top rail toward an adjacent side of the window sash. A driving member on the stem, such as a plurality of gear teeth around a lower end thereof, engages a driven member on the slide, such as a plurality of gear teeth forming a slide. Rotation of the stem by the latch handle moves the slide within the top rail between a first position where a nose of the slide extends beyond the adjacent side of a window sash and into a locking hole in the window frame and the sweep cam is engaged with the keeper, thus locking the window sash in place, and a second position where the nose of the slide is removed from the locking hole and the sweep cam is removed from the keeper, thus allowing the window sash to be moved within the window frame.

22 Claims, 6 Drawing Sheets

WINDOW LATCH WITH MULTIPLE LATCHING FEATURE

BACKGROUND OF THE INVENTION

1. Field of the Invention

This invention relates to window latches for double hung windows or the like.

2. Description of the Prior Art

The use of a window latch in connection with a double hung window or the like is well known. Typically, a latch housing is attached to an upper surface of a top rail of a locking window sash and a sweep cam is moved by a handle/stem arrangement into and out of the latch housing and into and out of engagement with a keeper on an adjacent window sash. Prior art patents in this area include U.S. Pat. No. 5,161,839 and U.S. Pat. No. 4,095,829. It is also common to provide the window sashes in a double hung window in an arrangement whereby the window sashes can be tilted into and out of engagement with the window frame. Typically, special latches are provided at each corner of each window sash and these latches are moved into and out of engagement with a slide track in the window frame to permit tilting of the window. See, for example, U.S. Pat. No. 5,398,447.

One of the disadvantages of the typical cam/keeper latch arrangement for windows is that the only secure fastening is provided by the cam engaging the keeper and fastening the adjacent window sashes together. It is known that providing a latch attached to the window sash and moving into and out of engagement with the window frame provides a much more secure latching arrangement. See, for example, U.S. Pat. Nos. 5,244,238; 5,090,750; 1,630,153; 671,957; 547,883 and 242,695. However, these arrangements are either quite complicated to use, require complicated mechanisms to be attached to an existing window sash, and require a separate cam/keeper arrangement to latch the window sashes together.

Accordingly, it is an object of the present invention to provide a window latch which will both latch the adjacent window sashes together and, without adding additional latching mechanisms, latch the window sashes securely to the window frame. It is a further object of the present invention to provide such a latch arrangement in which tilting of the window can also be provided without the use of separate tilt latches.

SUMMARY OF THE INVENTION

Accordingly, we have developed a multiple position window latch which includes a latch housing attachable to an upper surface of a top rail of a window sash. A stem extends through the latch housing and terminates in a lower end beneath the latch housing and within the top rail of the window sash. A latch handle is positioned above an upper surface of the latch housing and is attached to an upper end of the stem. Rotation of the latch handle rotates the stem about a longitudinal axis extending therethrough. A sweep cam is positioned within the latch housing and is attached to the stem. The sweep cam is configured to rotate into and out of the latch housing and engage a keeper on an adjacent window sash. An elongated slide is positioned beneath the latch housing and extends within the top rail toward an adjacent side of the window sash. A driving member on the stem, such as a plurality of gear teeth around the lower end thereof, engages a driven member on the slide, such as a plurality of gear teeth formed on the slide. Rotation of the stem by the latch handle moves the slide within the top rail in a plane perpendicular to the longitudinal axis through the stem. In this manner, rotation of the stem by the latch handle moves the slide between a first position where a nose of the slide extends beyond the adjacent side of the window sash and into a locking hole in the window frame and the sweep cam is engaged with the keeper, thus locking the window sash in place, and a second position where the nose of the slide is removed from the locking hole and the sweep cam is removed from the keeper, thus allowing the window sash to be moved within the window frame.

In a preferred embodiment, the nose of the slide extends into a slide track in the window frame in the second position and continued rotation of the stem by the latch handle from the second position moves the slide into a third position where the nose of the slide does not protrude beyond the adjacent side of the window sash, thus permitting the window sash to be tilted out of the window frame. It is also preferred that a detent, such as a spring loaded detent, be provided in the latch housing in order to prevent the latch handle from moving from the second position to the third position unless the detent is moved.

It is preferred that the slide be enclosed by a slide housing positioned within the top rail of the window sash and that the slide move within this slide housing. The slide housing can have an opening therein which permits the gear teeth or other driving mechanism on the stem to engage the gear teeth or other driven mechanism on the slide. A bias member preferably urges the slide toward the adjacent side of the window sash and functions to assist the slide in moving into the first or locked position. The bias member can include a spring extending between a shoulder on the slide and a shoulder on the slide housing.

DESCRIPTION OF THE PREFERRED EMBODIMENTS

Figure 1:
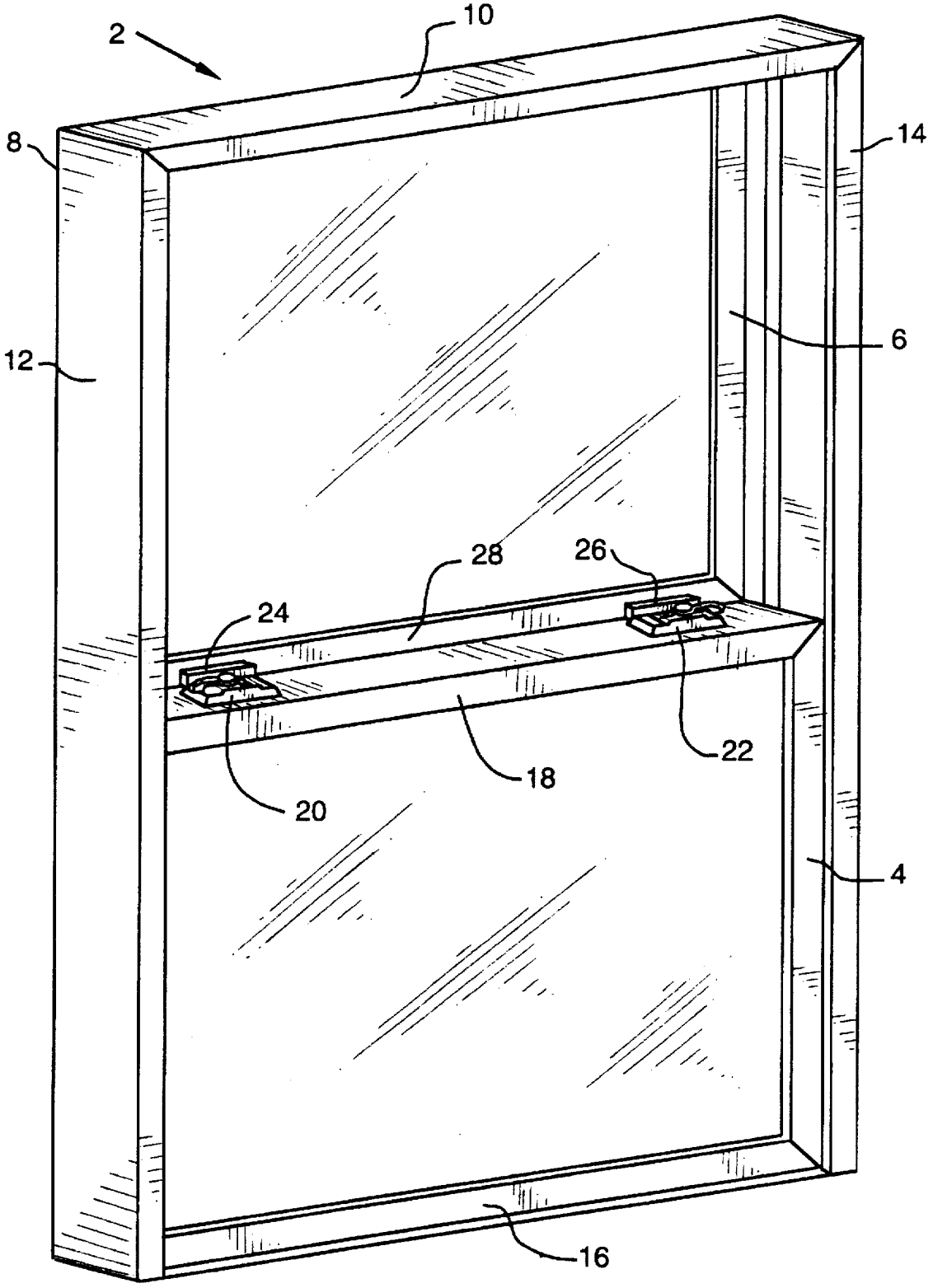
FIG. 1 is a perspective view of a double hung window including a pair of multiple position window latches in accordance with the present invention.

A window including multiple position window latches in accordance with the present invention is shown in FIG. 1.

The window 2 shown herein is a typical double hung window which includes a lower window sash 4 and an upper window sash 6 carried within a window frame 8 including a top frame 10, left side frame 12, right side frame 14 and a lower frame or sill 16 fastened together to form a rectangular box-like structure. The lower sash 4 includes a top or upper rail 18, also referred to as the locking rail, which has mounted on an upper surface thereof a pair of window latches 20 and 22 in accordance with the present invention. As will be described hereinafter in more detail, each window latch 20 and 22 includes a sweep cam which is moved by a latch handle to engage keepers 24 and 26, respectively, on the lower or mating rail 28 of the upper window sash 6. Window latches 20 and 22 shown in FIG. 1 are mirror images of each other and are positioned near the corners of the lower window sash 4 nearest the left side frame 12 and right side frame 14, respectively.

Figure 2:
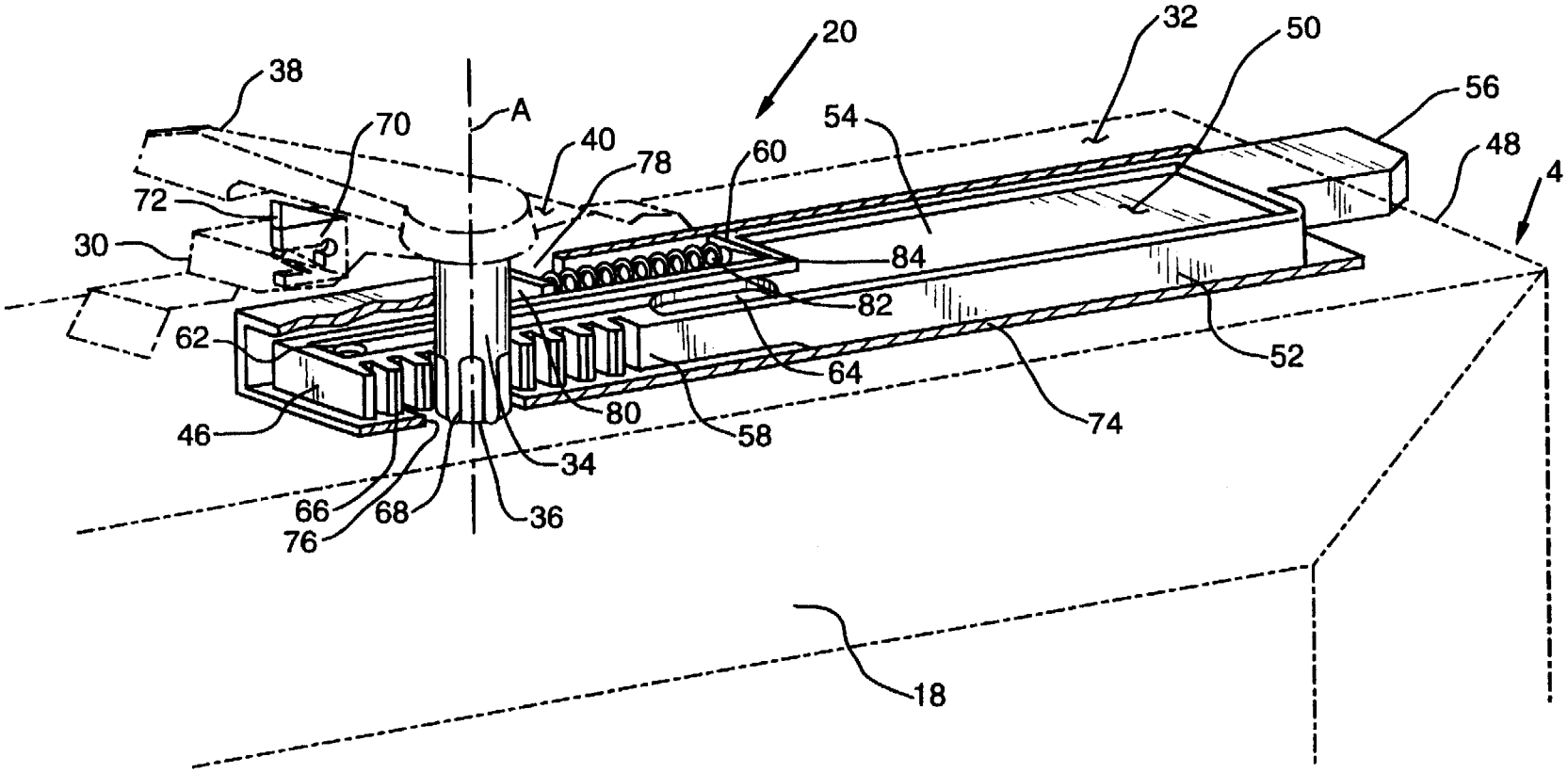
FIG. 2 is a perspective view, partially broken away, of a multiple position window latch in accordance with the present invention.
Figure 4:
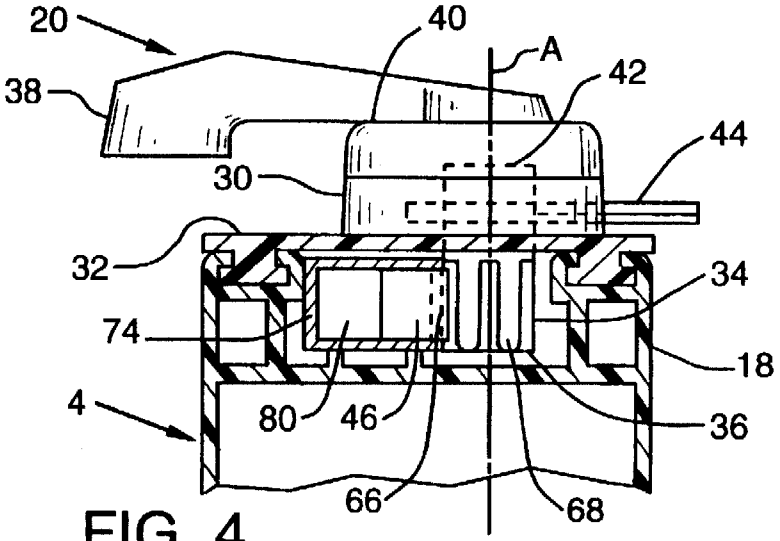
FIG. 4 is a section through a window rail including the window latch of FIG. 2.
Figure 3:
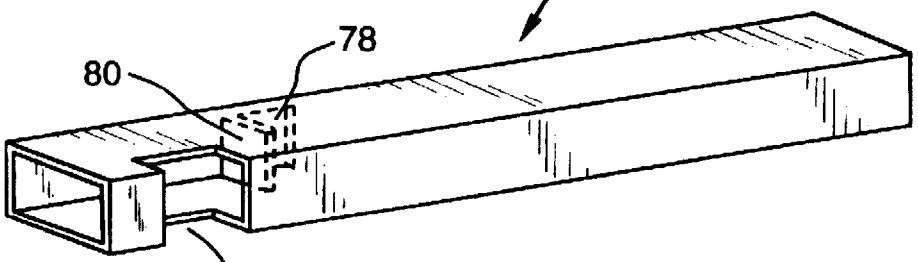
FIG. 3 is a perspective view of the slide housing used in the window latch shown in FIG. 2.
Figure 5:
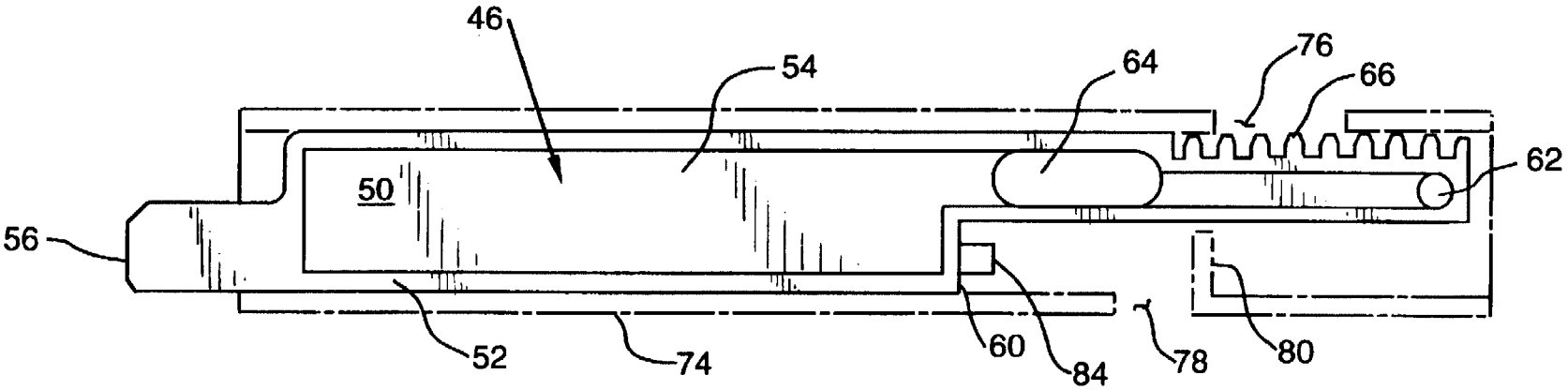
FIG. 5 is a top plan view of the slide used in the window latch shown in FIG. 2.

FIGS. 2–5 show the elements of the left window latch 20 in accordance with the present invention as shown in FIG. 1. It is to be understood that the right window latch 22 shown in FIG. 1 includes all of the elements in the left window latch 20 but is the mirror image of what is shown in FIG. 2. The left window latch 20 includes a latch housing 30 which is attached to the upper surface 32 of the top rail 18 of the lower window sash 4. A cylindrical stem 34 extends through the latch housing 30 and terminates in a lower end 36 beneath the latch housing and within the top rail 18 of the lower window sash 4. This stem 34 is elongated when compared to the stems in prior art window latches. A latch handle 38 is positioned above an upper surface 40 of the latch housing 30 and is attached to an upper end 42 of the stem 34. Rotation of the latch handle 38 functions to rotate the stem 34 about a longitudinal axis A extending through the stem 34. A sweep cam 44 is positioned within the latch housing 30 and is attached to the stem 34. In this manner, the sweep cam 44 rotates along with the stem 34 by the latch handle 38. The sweep cam 44 is configured to rotate into and out of the latch housing 30 and engage a keeper on an adjacent window sash and, thereby, latch the two windows together.

An elongated slide 46 is positioned within the top rail 18 of the lower window sash 4, beneath the latch housing 30, and extends toward an adjacent side 48 of the lower window sash 4 and toward the adjacent side of the window frame. The slide 46 is a flat, essentially rectangularly shaped member having a thin, web-like center 50 and a wider peripheral edge 52. This structure provides a strong, yet lightweight slide 46. The slide 46 has a wider main portion 54 having a nose 56 attached at one side thereof and oriented toward the adjacent side 48 of the lower window sash 4. The slide 46 has a narrow leg 58 extending from the other side thereof and defining shoulder 60. A small hole 62 extends through the leg 58 of the slide 46 toward the end thereof furthest from the main portion 54. Hole 62 is included to provide a mechanism whereby the slide 46 can be hung for painting, galvanizing or the like. An elongated clearance slot 64 is provided through the leg 58 of the slide 46, closer to the main portion 54 of the slide 46. The function of this clearance slot 64 will be described hereinafter in more detail.

A plurality of gear teeth 66, forming a rack-like arrangement on the side of the leg 58 of the slide 46 opposite the shoulder 60, functions as a driven member for the slide 46. The lower end 36 of the stem 34 carries a plurality of gear teeth 68 thereabout which is configured to function as a driving member and engages the gear teeth 66 on the slide 46 when the slide 46 is positioned beneath the latch housing 30. In this manner, rotation of the stem 34 by the latch handle 38 functions to move the slide 46 within the top rail 18 in a plane perpendicular to the longitudinal axis A extending through the stem 34. In other words, movement of the latch handle 38 rotates the stem 34 and that movement is translated into horizontal movement of the slide 46 into and out of the adjacent side 48 of the lower window sash 4, as determined by the length of the slide 46. As will be explained hereinafter in more detail, the slide 46 and nose 56 are configured such that the nose 56 is fully extended beyond the adjacent side 48 of the window sash 4 in a first position, is retracted from the fully extended position but still extends beyond the adjacent side 48 of the window sash 4 in a second position and is fully retracted within the top rail 18 of the window sash 4 in a third position.

In order to keep the slide 46 from moving from the second or partially retracted position to the third or fully retracted position, which enables the window sash 4 to be tilted out of a window frame, a plastic, spring loaded detent 70 is provided in the latch housing 30 and has a tab 72 which extends above the upper surface 40 of the latch housing 30. The detent 70 functions to keep the latch handle 38 from moving beyond the position of the detent 70 and into the third position unless the tab 72 of the detent 70 is depressed. In this manner, the latch handle 38 can then move freely over the detent 70 and move the slide 46 into the third position with the slide nose 56 fully retracted within the window sash 4.

As discussed above, the sweep cam 44 is attached to and rotates with the stem 34. When the latch handle 38 is moved to the first position, the sweep cam 44 is fully extended from the latch housing 30 and can engage a keeper. When the latch handle 38 is moved to the second position, the sweep cam 44 is withdrawn from a keeper and essentially retracted within the latch housing 30. The sweep cam 44 remains within the latch housing when the latch handle 38 is moved to the third position.

It is preferred that the slide 46 within the top rail 18 of the window sash 4 be enclosed in a slide housing 74, such as the elongated, box-like rectangular housing, with open ends, shown in the figures. The slide housing 74 functions to securely hold the slide 46 therein when the window latch 20 of the present invention is installed in, for example, a plastic extruded window frame. The slide housing 74 has an opening or cut out 76 at one end on the side thereof in the area where the gear teeth 66 on the slide 46 are located so that the stem 34 can extend into this opening 76 and engage its gear teeth 68 to the gear teeth 66 on the slide 46. It is preferred that a spring bias means be provided to normally urge the slide 46 toward the adjacent side 48 of the window frame 4. In this regard, a notch 78 is cut in the side of the slide housing 74 opposite the opening 76 and is bent to form a shoulder 80 for the slide housing 74. A bias spring 82 extends between and contacts the shoulder 60 on the slide 46 and the shoulder 80 in the slide housing 74. The end of the spring 82 in contact with the shoulder 60 on the slide 46 can engage a pin 84 thereon to keep the spring 82 securely in place.

Figure 6:
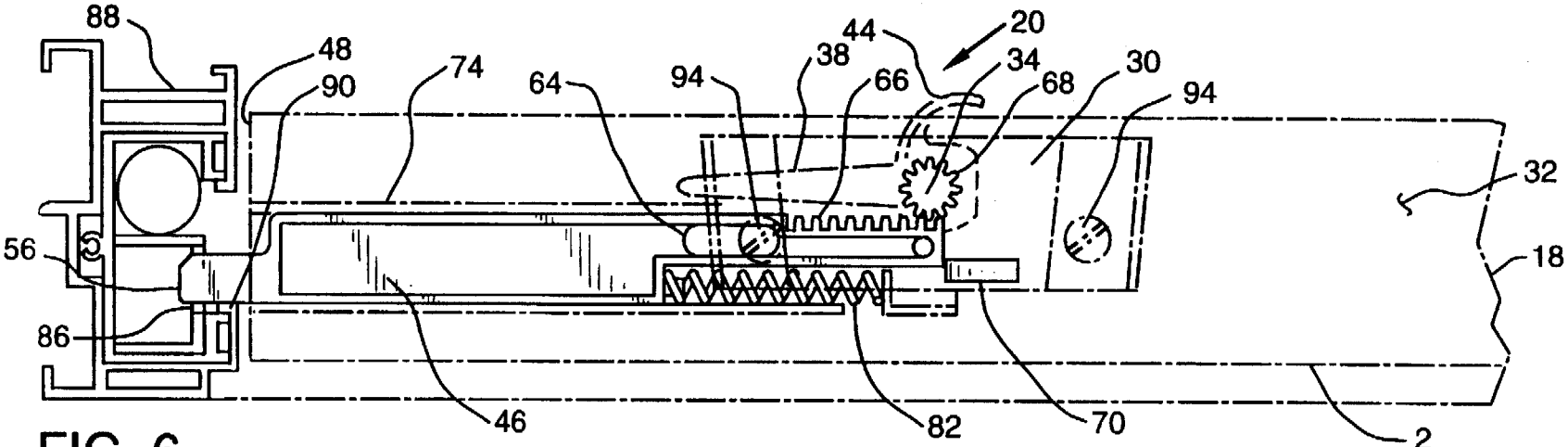
FIG. 6 is a top plan view of a window including the window latch of the present invention in a locked position.
Figure 7:
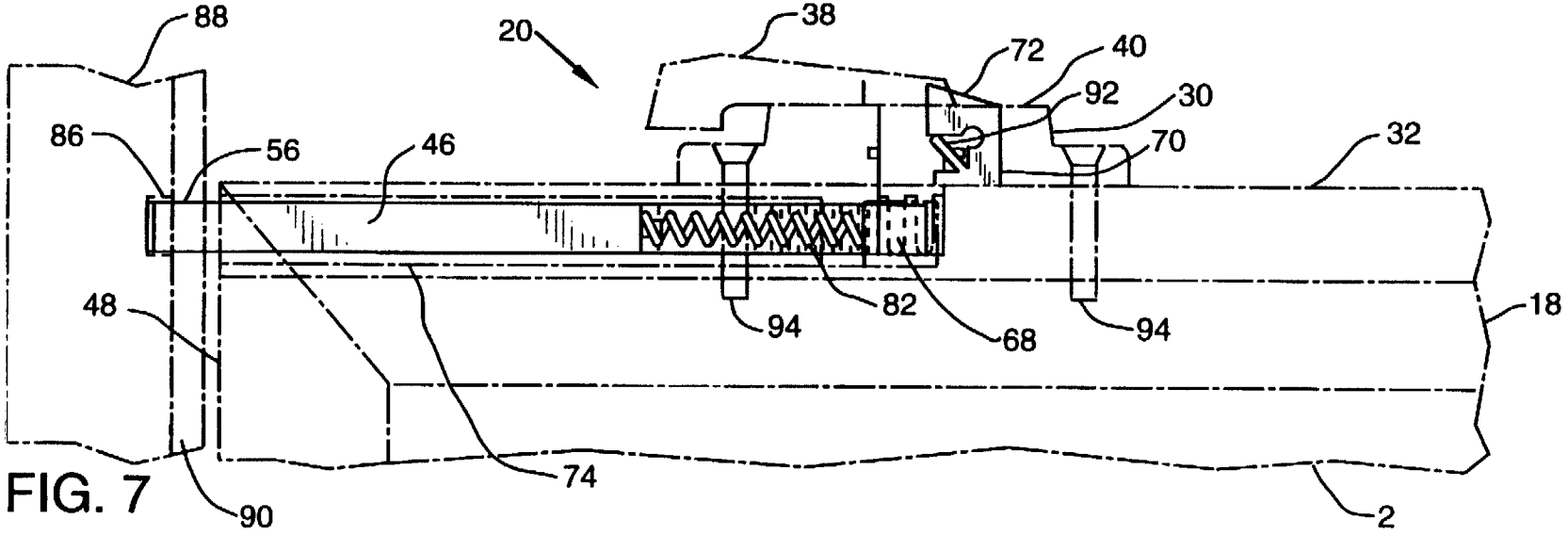
FIG. 7 is a front view of the window shown in FIG. 6.

The operation of the multiple position window latch 20 in accordance with the present invention is shown in FIGS. 6–12. By appropriately rotating the latch handle 38 attached to the stem 34, the slide 46 can be moved to a first position where the nose 56 of the slide 46 extends beyond the side 48 of the window sash 4 and into a locking hole 86 in the adjacent window frame 88 and the sweep cam 44 is engaged with the keeper (not shown). This locked position is shown in FIGS. 6 and 7. Although the latch handle 38 could be oriented in a number of ways, in FIGS. 6 and 7 the latch handle 38 is shown pointing toward the window frame 88 when the window latch 20 is in the first or locked position. Rotating the latch handle 38 by 90 degrees to a second position draws the slide 46 at least partially into the window sash 4 and out of engagement with the locking hole 86 and also removes the sweep cam 44 from the keeper. This second position, also referred to as a sliding position, is shown in more detail in FIGS. 8 and 9. In this position of the latch handle 38, which points directly away from the window sash 4 and toward a user, the window sash 4 can be operated in a normal, sliding position. The nose 56 of the slide 46 protrudes slightly beyond the adjacent side 48 of the window sash 4 and into a slide track 90 in the window frame 88.

Figure 8:
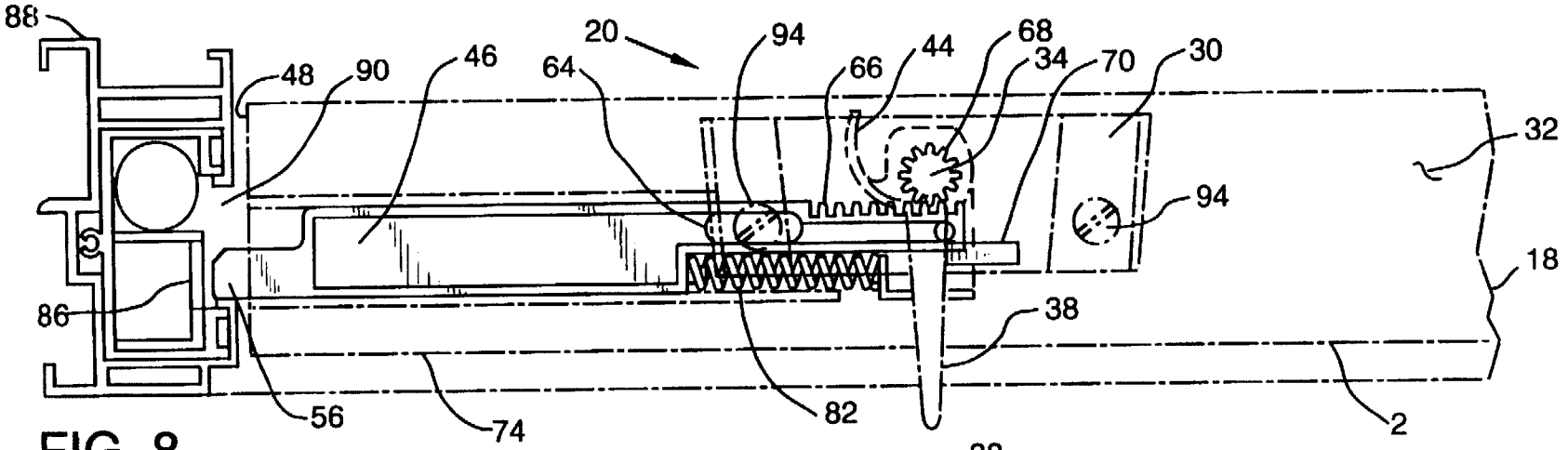
FIG. 8 is a top plan view of the window shown in FIG. 6 with the window latch in a sliding position.
Figure 9:
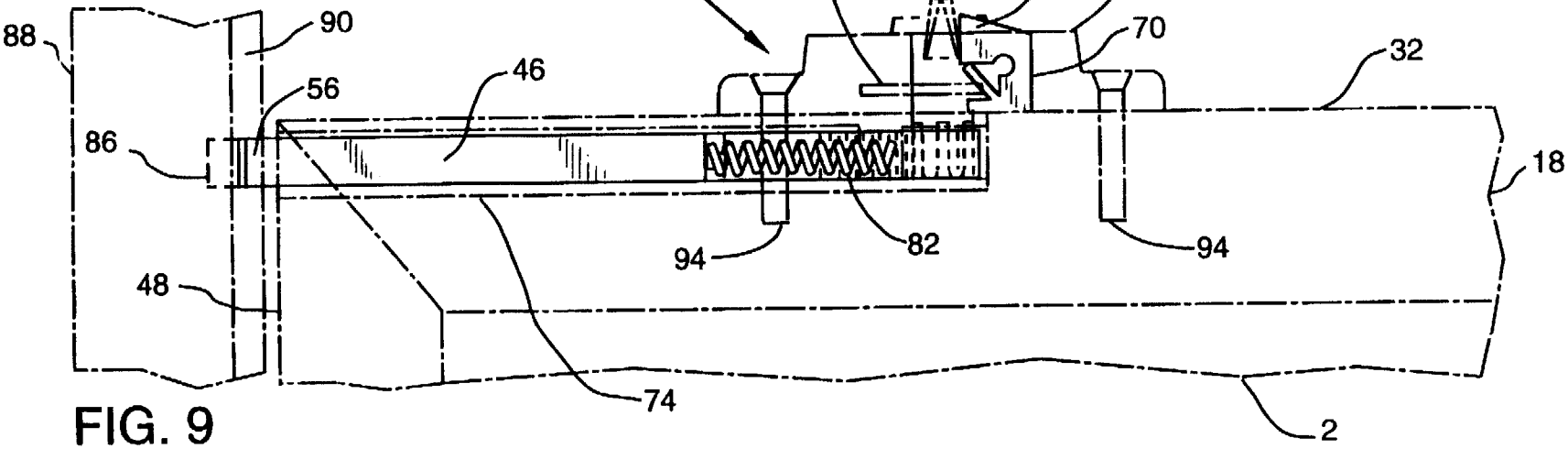
FIG. 9 is a front view of the window shown in FIG. 8.
Figures 10, 11, 12:
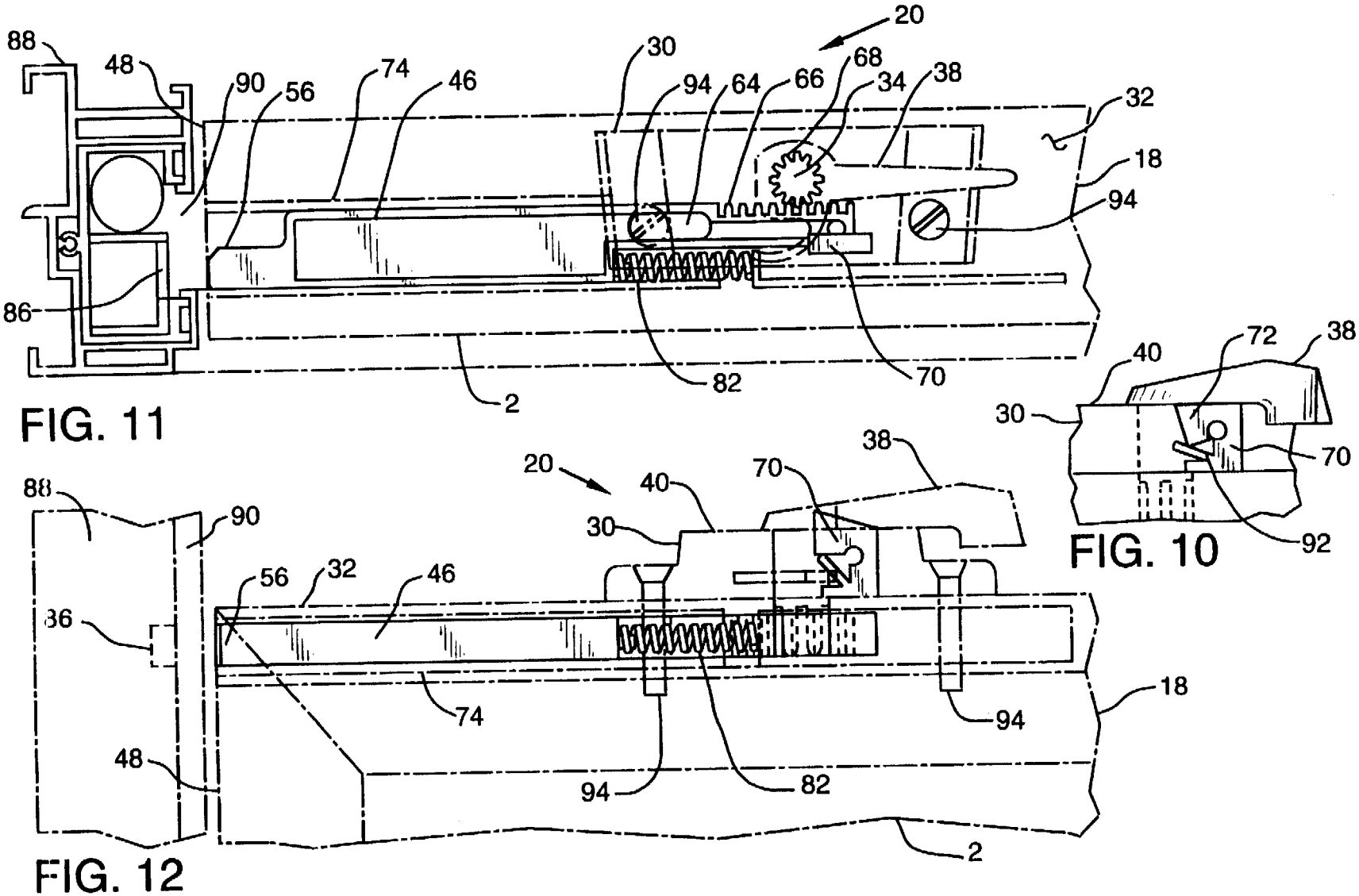
FIG. 10 is an enlarged view of a portion of the window latch shown in FIG. 6 with the detent depressed under the latch handle.
FIG. 11 is a top plan view of the window shown in FIG. 6 with the window latch in a tilted position.
FIG. 12 is a front view of the window shown in FIG. 11.

It can be seen in FIGS. 8 and 9 that the latch handle 38 cannot be further rotated in the counterclockwise direction due to the action of the detent 70. As shown in FIG. 10, by depressing the tab 72 on the detent 70, the latch handle 38 can be moved further to a third position and retract the slide 46 totally within the top rail 18 of the window sash 4. This position is shown in FIGS. 11 and 12. In this manner, the nose 56 of the slide 46 is totally withdrawn from the window frame 88 and the window sash 4 can thereafter be tilted out of the window frame for cleaning and the like. The detent 70 has a spring member 92 therein within the latch housing 30 which functions to bias the detent 70 upward and return it to its original position once the latch handle 38 is moved thereover. As shown in FIG. 12, the tab 72 on the detent 70 is sloped such that returning the latch handle 38 from the third position to the second position can be done without manually depressing the tab 72 on the detent 70. The highest portion of the sloped tab 72 provides a distinct stop member to keep the latch handle 38 from accidentally moving to the third or tilted position.

The clearance slot 64 in the leg 58 of the slide 46 is provided to allow a locking screw 94 which attaches the latch housing 30 to the window sash 4 to pass through the slide 46 located therebeneath yet not provide any interference to movement of the slide 46 therein. This is shown more clearly in, sequentially, FIGS. 6, 8 and 11. The clearance slot 64 has a length at least as long as the normal travel of the slide 46 from the first to the third positions. It can also be seen in FIGS. 6–12 that the bias spring 82 is compressed as the slide 46 is moved from the first position to the third position and provides an outward biased force which eases the return of the latch handle 38 from the third position to the first position.

Attaching a pair of window latches of the present invention on opposite corners of the top rail of a window sash provides not only for locking the sweep cam to the keeper on an adjacent window sash while locking the window sash to the window frame, yet also provides a mechanism for easily moving the sweep cam and slide to an unlocked and normally operational position for normal sliding of the window sash, and also to a third position permitting the window sash to be tilted out of the window frame. This structure is provided in a relatively uncomplicated arrangement which is easy to use, is built into the window, and leaves only two latch housings and associated handles visible to the user. It is preferred that the various elements of the window latch, other than the detent, be made of metal.

Having described above the presently preferred embodiments of the present invention, it is to be understood that the invention may be otherwise embodied within the scope of the following claims.

We claim:

1. A multiple position window latch comprising:

a latch housing attached to an upper surface of a top rail of a window sash;

a stem extending through the latch housing and terminating in a lower end beneath the latch housing and within the top rail of the window sash;

a latch handle positioned above an upper surface of the latch housing and attached to an upper end of the stem, whereby rotation of the latch handle rotates the stem about a longitudinal axis extending therethrough;

a sweep cam positioned within the latch housing and attached to the stem, with the sweep cam configured to rotate into and out of the latch housing and engage a keeper on an adjacent window sash;

an elongated slide positioned beneath the latch housing and extending within the top rail toward an adjacent side of the window sash;

a driving member on the stem which engages a driven member on the slide such that rotation of the stem moves the slide within the top rail in a plane perpendicular to the longitudinal axis through the stem;

whereby rotation of the stem by the latch handle moves the slide from a first position where a nose of the slide extends beyond the adjacent side of the window sash and into a locking hole in a window frame and the sweep cam is engaged with the keeper, thus locking the window sash in place, to a second position where the nose of the slide is removed from the locking hole and the sweep cam is removed from the keeper, thus allowing the window sash to be moved within the window frame, wherein in the second position the nose of the slide extends into a slide track in the window frame, and whereby continued rotation of the stem by the latch handle from the second position moves the slide into a third position where the nose of the slide does not protrude beyond the side of the window sash, thus allowing the window sash to be tilted out of the window frame, and a detent in the latch housing which prevents the latch handle from moving from the second position to the third position unless the detent is moved.

2. The window latch of claim 1 wherein the detent is a spring loaded detent having a tab which extends above the upper surface of the latch housing and which is depressible to a position at least flush with the upper surface of the latch housing.

3. A multiple position window latch comprising:

a latch housing attached to an upper surface of a top rail of a window sash;

a stem extending through the latch housing and terminating in a lower end beneath the latch housing and within the top rail of the window sash;

a latch handle positioned above an upper surface of the latch housing and attached to an upper end of the stem, whereby rotation of the latch handle rotates the stem about a longitudinal axis extending therethrough;

a sweep cam positioned within the latch housing and attached to the stem, with the sweep cam configured to rotate into and out of the latch housing and engage a keeper on an adjacent window sash;

an elongated slide positioned beneath the latch housing and extending within the top rail toward an adjacent side of the window sash; and a driving member on the stem which engages a driven member on the slide such that rotation of the stem moves the slide within the top rail in a plane perpendicular to the longitudinal axis through the stem;

whereby rotation of the stem by the latch handle moves the slide between a first position where a nose of the slide extends beyond the adjacent side of the window sash and into a locking hole in a window frame and the sweep cam is engaged with the keeper, thus locking the window sash in place, and a second position where the nose of the slide is removed from the locking hole and the sweep cam is removed from the keeper, thus allowing the window sash to be moved within the window frame; and wherein the driving member on the stem is a plurality of gear teeth around the lower end thereof and the driven member on the slide is a plurality of gear teeth forming a rack therein; a detent in the latch housing which prevents the latch handle from being further moved beyond the second position unless the detent is moved.

4. The window latch of claim 3 wherein the slide is enclosed by a slide housing positioned within the top rail of the window sash and the slide moves within the slide housing.

5. The window latch of claim 4 wherein the slide housing has an opening therein which permits the gear teeth on the stem to engage the gear teeth on the slide.

6. The window latch of claim 4 further including a bias member which urges the slide toward the adjacent side of the window sash.

7. The window latch of claim 6 wherein the bias member includes a spring extending between a shoulder on the slide and a shoulder on the slide housing.

8. A window having a pair of spaced apart multiple position window latches attached to an upper surface of a top rail of a locking window sash, with one window latch positioned near one corner of the locking window sash and the other window latch positioned near another corner of the locking window sash, with each window latch comprising:

a latch housing attached to the upper surface of the top rail of the locking window sash;

a stem extending through the latch housing and terminating in a lower end beneath the latch housing and within the top rail of the locking window sash;

a latch handle positioned above an upper surface of the latch housing and attached to an upper end of the stem, whereby rotation of the latch handle rotates the stem about a longitudinal axis extending therethrough;

a sweep cam positioned within the latch housing and attached to the stem, with the sweep cam configured to rotate into and out of the latch housing and engage a keeper on an adjacent window sash;

an elongated slide positioned beneath the latch housing and extending within the top rail toward an adjacent side of the locking window sash; and a driving member on the stem which engages a driven member on the slide such that rotation of the stem moves the slide within the top rail in a plane perpendicular to the longitudinal axis through the stem;

whereby rotation of the stem by the latch handle moves the slide between a first position where a nose of the slide extends beyond the adjacent side of the locking window sash and into a locking hole in a window frame and the sweep cam is engaged with the keeper, thus locking the locking window sash in place, and a second position where the nose of the slide is removed from the locking hole and the sweep cam is removed from the keeper, thus allowing the locking window sash to be moved within the window frame.

9. The window of claim 8 wherein, for each window latch, in the second position the nose of the slide extends into a slide track in the window frame and whereby continued rotation of the stem by the latch handle from the second position moves the slide into a third position where the nose of the slide does not protrude beyond the adjacent side of the locking window, thus permitting the locking window sash to be tilted out of the window frame.

10. The window of claim 9 wherein each window latch further includes a detent in the latch housing which prevents the latch handle from moving from the second position to the third position unless the detent is moved.

11. The window of claim 10 wherein the detent is a spring loaded detent having a tab which extends above the upper surface of the latch housing and which is depressible to a position at least flush with the upper surface of the latch housing.

12. The window of claim 8 wherein the driving member on the stem is a plurality of gear teeth around the lower end thereof and the driven member on the slide is a plurality of gear teeth forming a rack therein.

13. The window of claim 12 wherein the slide is enclosed by a slide housing positioned within the top rail of the locking window sash and the slide moves within the slide housing.

14. The window of claim 13 wherein the slide housing has an opening therein which permits the gear teeth on the stem to engage the gear teeth on the slide.

15. The window of claim 13 further including, in each window latch, a bias member which urges the slide toward the adjacent side of the locking window sash.

16. The window of claim 15 wherein the bias member includes a spring extending between a shoulder on the slide and a shoulder on the slide housing.

17. A multiple position window latch comprising:

a latch housing attached to an upper surface of a top rail of a window sash;

a stem extending through the latch housing and terminating in a lower end beneath the latch housing and within the top rail of the window sash;

a latch handle positioned above an upper surface of the latch housing and attached to an upper end of the stem, whereby rotation of the latch handle rotates the stem about a longitudinal axis extending therethrough;

a sweep cam positioned within the latch housing and attached to the stem, with the sweep cam configured to rotate into and out of the latch housing and engage a keeper on an adjacent window sash;

an elongated slide positioned beneath the latch housing and extending within the top rail toward an adjacent side of the window sash;

a plurality of gear teeth around the lower end of the stem which engages a plurality of gear teeth forming a rack on the slide, such that rotation of the stem moves the slide within the top rail in a plane perpendicular to the longitudinal axis through the stem, whereby rotation of the stem by the latch handle moves the slide in turn from a first position where a nose of the slide extends beyond the adjacent side of the window sash and into a locking hole in a window frame and the sweep cam is engaged with the keeper, thus locking the window sash in place, to a second position where the nose of the slide is moved from the locking hole to a slide track in the window frame and the sweep cam is removed from the keeper, thus allowing the window sash to slide normally within the window frame, and to a third position where the nose of the slide does not protrude beyond the side of the window sash, thus allowing the window sash to be tilted out of the window frame; and a detent in the latch housing which prevents the latch handle from moving from the second position to the third position unless the detent is moved.

18. The window latch of claim 17 wherein the detent is a spring loaded detent having a tab which extends above the upper surface of the latch housing and which is depressible to a position at least flush with the upper surface of the latch housing.

19. The window latch of claim 17 wherein the slide is enclosed by a slide housing positioned within the top rail of the window sash and the slide moves within the slide housing.

20. The window latch of claim 19 wherein the slide housing has an opening therein which permits the gear teeth on the stem to engage the gear teeth on the slide.

21. The window latch of claim 19 further including a bias member which urges the slide toward the adjacent side of the window sash.

22. The window latch of claim 21 wherein the bias member includes a spring extending between a shoulder on the slide and a shoulder on the slide housing.

* * * * *